US007448098B2

(12) United States Patent
Cheng

(10) Patent No.: US 7,448,098 B2
(45) Date of Patent: Nov. 11, 2008

(54) STRUCTURE OF A CURVED FRAME OF A BABY MESH BED

(76) Inventor: Ying-Hsiung Cheng, No. 14, Lane 477, Chung Shan Rd., Jen Te Hsiang, Tainan Hsien (TW)

( * ) Notice: Subject to any disclaimer, the term of this patent is extended or adjusted under 35 U.S.C. 154(b) by 86 days.

(21) Appl. No.: 11/500,348

(22) Filed: Aug. 8, 2006

(65) Prior Publication Data

US 2008/0034497 A1 Feb. 14, 2008

(51) Int. Cl.
*A47D 7/00* (2006.01)

(52) U.S. Cl. ..... 5/99.1; 5/93.1

(58) Field of Classification Search ..... 5/93.1, 5/98.1, 99.1
See application file for complete search history.

(56) References Cited

U.S. PATENT DOCUMENTS

2006/0037137 A1* 2/2006 Song ..... 5/99.1

* cited by examiner

*Primary Examiner*—Fredrick Conley
(74) *Attorney, Agent, or Firm*—Rosenberg, Klein & Lee

(57) ABSTRACT

A baby mesh bed consists of an upper enclosing member, which has four curved parts, and several stepped curved rods; each curved part is arranged on one of four corners of the upper enclosing member, and has adjacent large and small internal hollowness in each one of two ends, a hole on each end of an inner side, and a slot on each end of an outer side; the internal hollowness have the same curvature as the two sides of the curved parts; the curved rods are pivoted to the curved parts by means of pins, which are passed through corresponding holes and slots of the curved parts at two ends thereof; therefore, the mesh bed has curved corners instead of right-angled ones; each curved rod will be received in the corresponding adjacent large and small hollowness when the mesh bed is in a stretched position.

3 Claims, 8 Drawing Sheets

STRUCTURE OF A CURVED FRAME OF A BABY MESH BED

BACKGROUND OF THE INVENTION

1. Field of the Invention

The present invention relates to a curved frame structure of a baby mesh bed, more particularly one, which has curved corners instead of right-angled ones, and has a smoothly curved shape; thus, people won't get injured even if they hit the corners of the baby mesh bed.

2. Brief Description of the Prior Art

Most babies learn to sit and crawl at six to seven months of age, and learn to walk at twelve months of age. And, babies will become more curious and lively when they learn to walk, run, and jump. Therefore, mesh beds are available and widely used, which provide a relatively space for babies at this age to play in, thus preventing the babies from getting injured. Referring to FIG. 8, a widely used mesh bed 7 consists of an upper enclosing member, four upright rods 71, and four foot members 72 joined to lower ends of the upright rods 71. The upper enclosing member consists of foldable connecting rods, and right-angled corner parts 73, which are joined to respective ones of upper ends of the upright rods 71. The baby mesh bed 7 isn't very safe to use because people will feel pain and even get injured if they hit the right angle of the corner parts 73.

SUMMARY OF THE INVENTION

It is a main object of the invention to provide an improvement on a frame of a mesh bed to overcome the above-mentioned problems. The baby mesh bed of the present invention consists of an upper enclosing member, which has four curved parts, and several stepped curved rods; each of the curved parts is arranged on one of four corners of the upper enclosing member, and has adjacent large and small internal hollowness in each one of two ends, a hole on each end of an inner side, and a slot on each end of an outer side. The internal hollowness has the same curvature as the inner and the outer sides of the curved parts. The curved rods are pivoted to the curved parts by means of pins, which are passed through corresponding holes and slots of the curved parts at two ends thereof. Therefore, the mesh bed has curved corners instead of right-angled ones. And, a tail end of each curved rod will be received in corresponding adjacent large and small hollowness when the mesh bed is in a stretched position.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
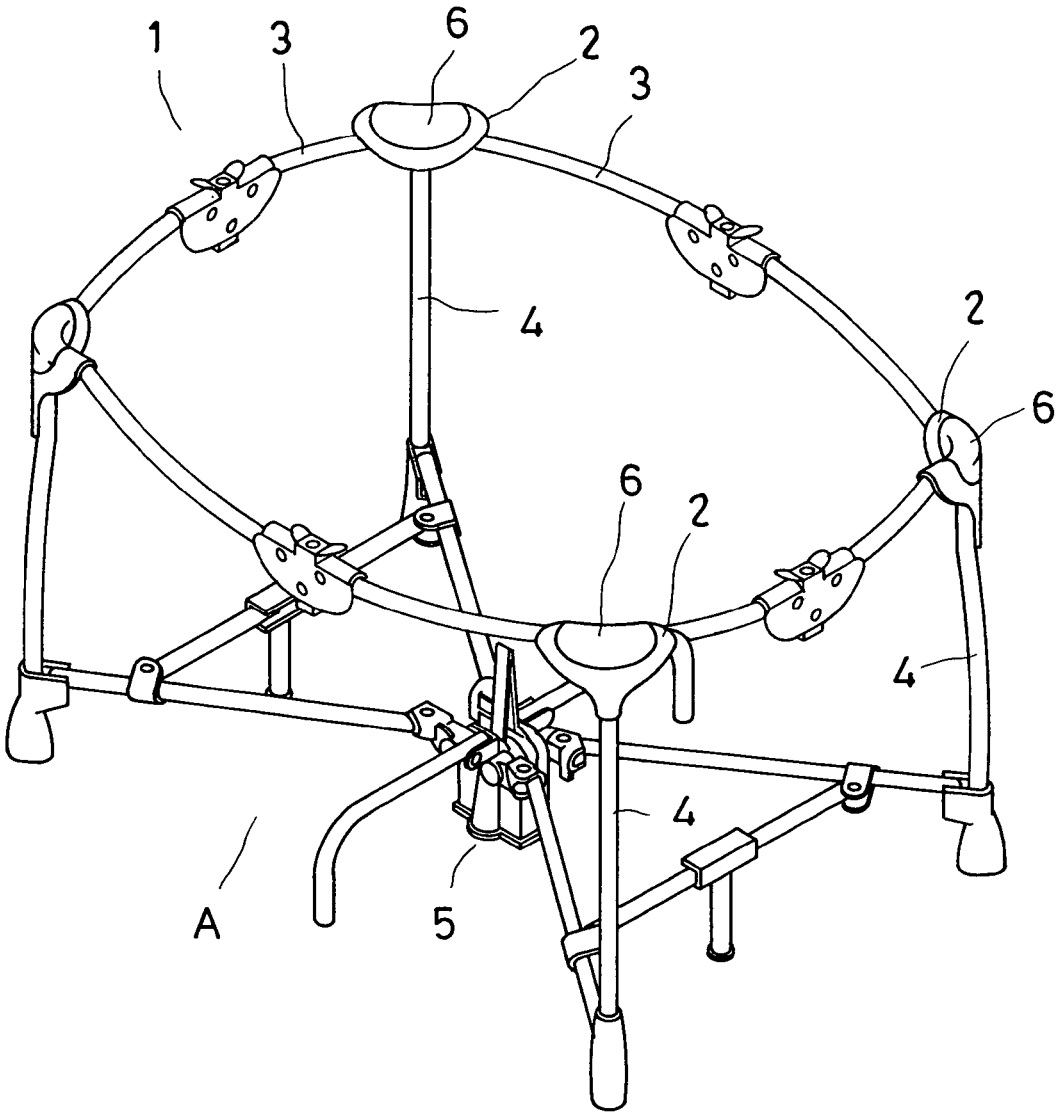
FIG. 1 is a perspective view of the present invention.
Figure 2:
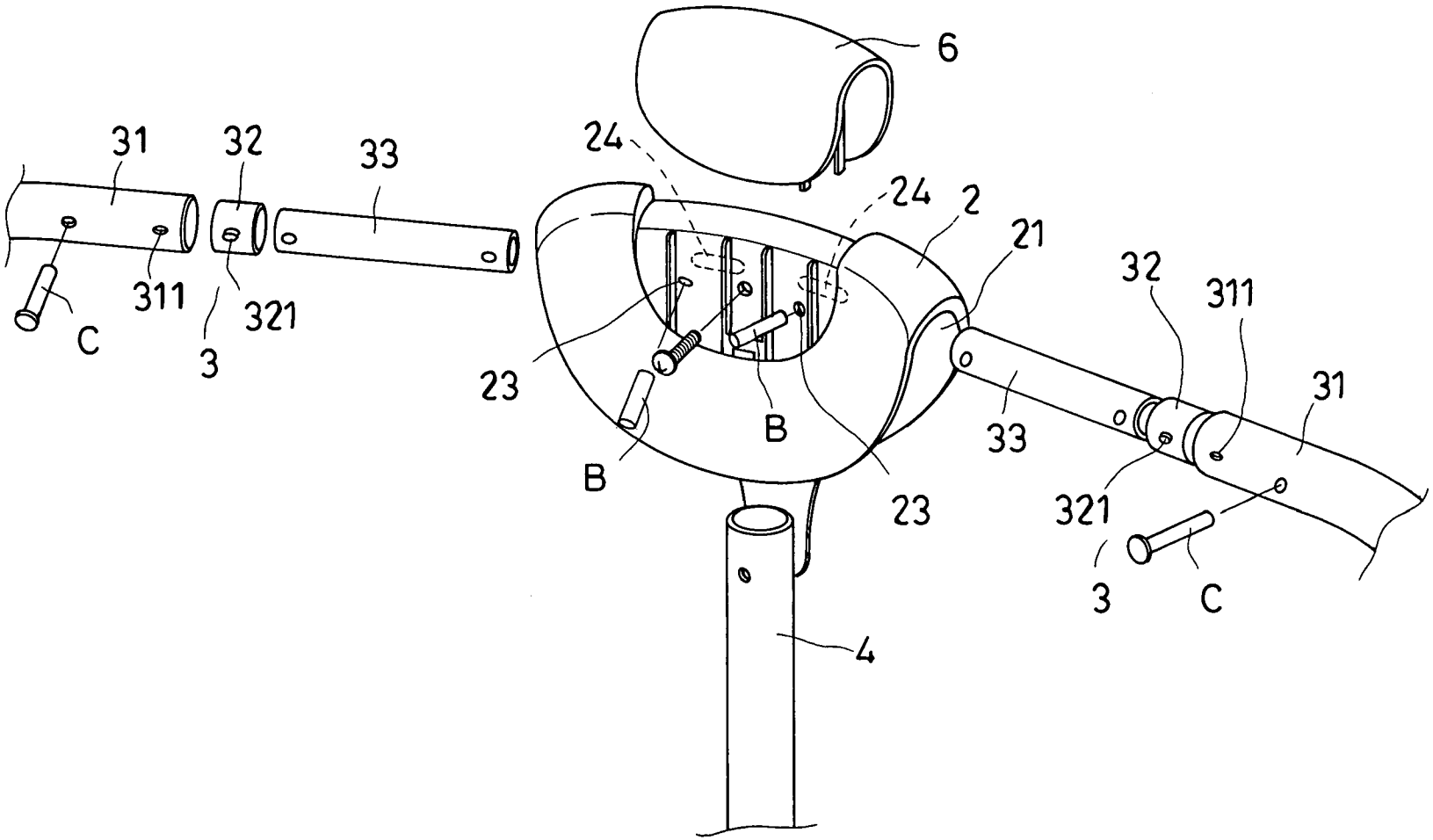
FIG. 2 is a fragmentary exploded perspective view of the present invention.
Figure 3:
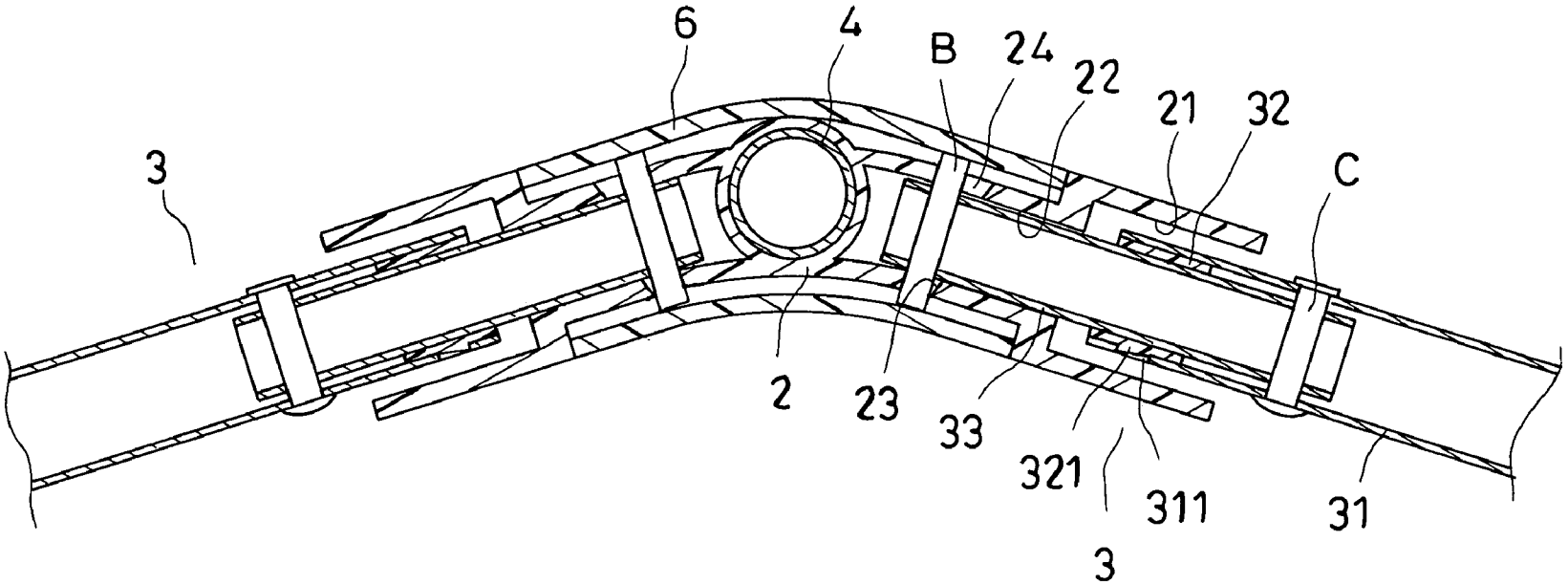
FIG. 3 is a partial sectional view of the present invention, taken when the baby mesh bed is in a stretched position.

Referring to FIGS. 1 to 3, a preferred embodiment of a curved frame (A) of a baby mesh bed consists of an upper enclosing member 1, four straight rods 4, and a base 5. The upper enclosing member 1 consists of four curved parts 2, and stepped curved rods 3; the curved parts 2 are each arranged on a respective one of four corners of the upper enclosing member 1 while the stepped curved rods 3 are pivoted to the curved parts 2. The straight rods 4 are each securely joined to a middle portion of a respective one of the curved parts 2 of the upper enclosing member 1, and they are connected to the base 5 at lower ends thereof.

Each of the curved parts 2 has a pair of adjacent large and small internal hollowness 21, 22 in each one of two ends thereof, which have the same curvature as a main body of the curved part 2, and which together form a step shape. Each of the curved parts 2 has a hole 23 on each end of an inner one of two opposing sides thereof, and a slot 24 on each end of an outer one of the two opposing sides.

Each of the stepped curved rods 3 consists of a first curved rod part 31, a sleeve pad 32, and a second curved rod part 33; the first curved rod part 31 has a hole 311, and an inner diameter larger than an outer diameter of the second curved rod part 33; the sleeve pad 32 has a protruding portion 321, and it is fitted in the first curved rod part 31 with the protruding portion 321 being fitted in the hole 311 of the first curved rod part 31; the second curved rod part 33 is fitted in the sleeve pad 32, and the curved rod parts 31, 33 and the sleeve pad 32 are secured together by means of a pin (C) passed through them.

Figure 4:
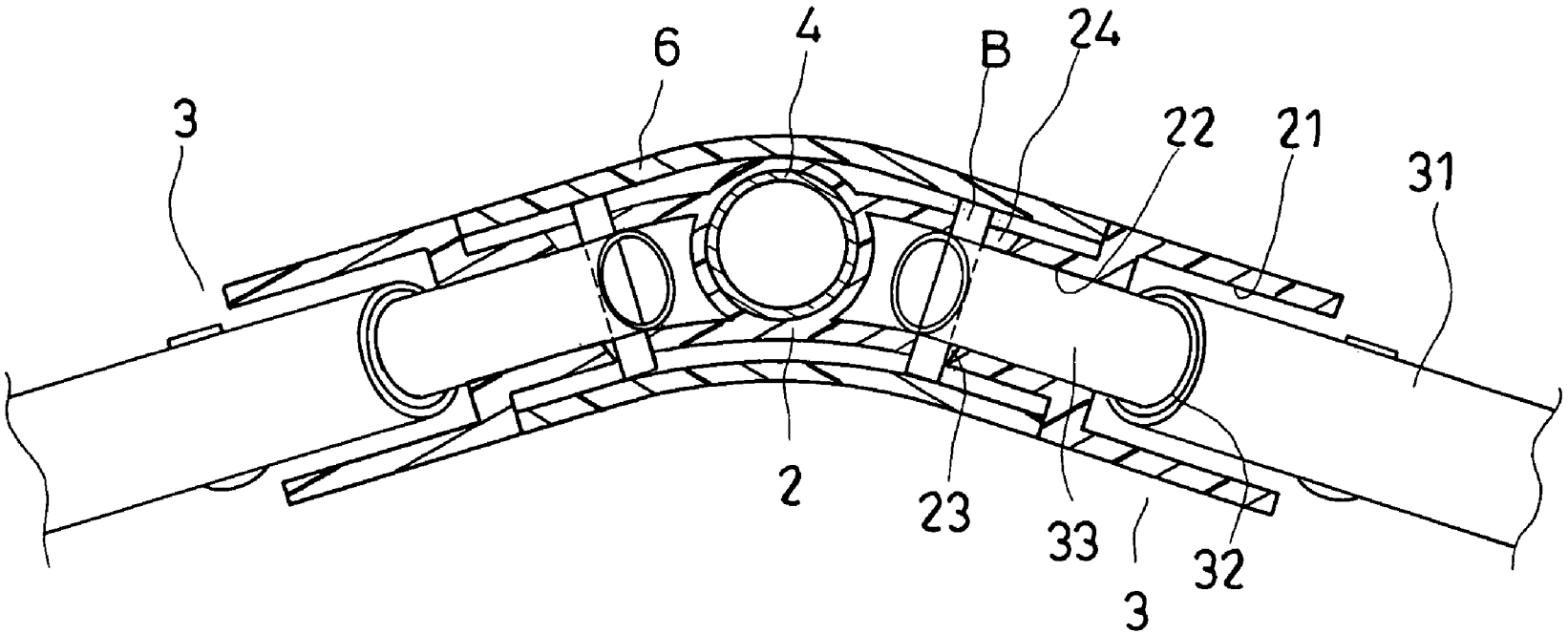
FIG. 4 is a partial sectional view of the invention, taken when the baby mesh bed is being moved towards a stretched/folded position.
Figure 5:
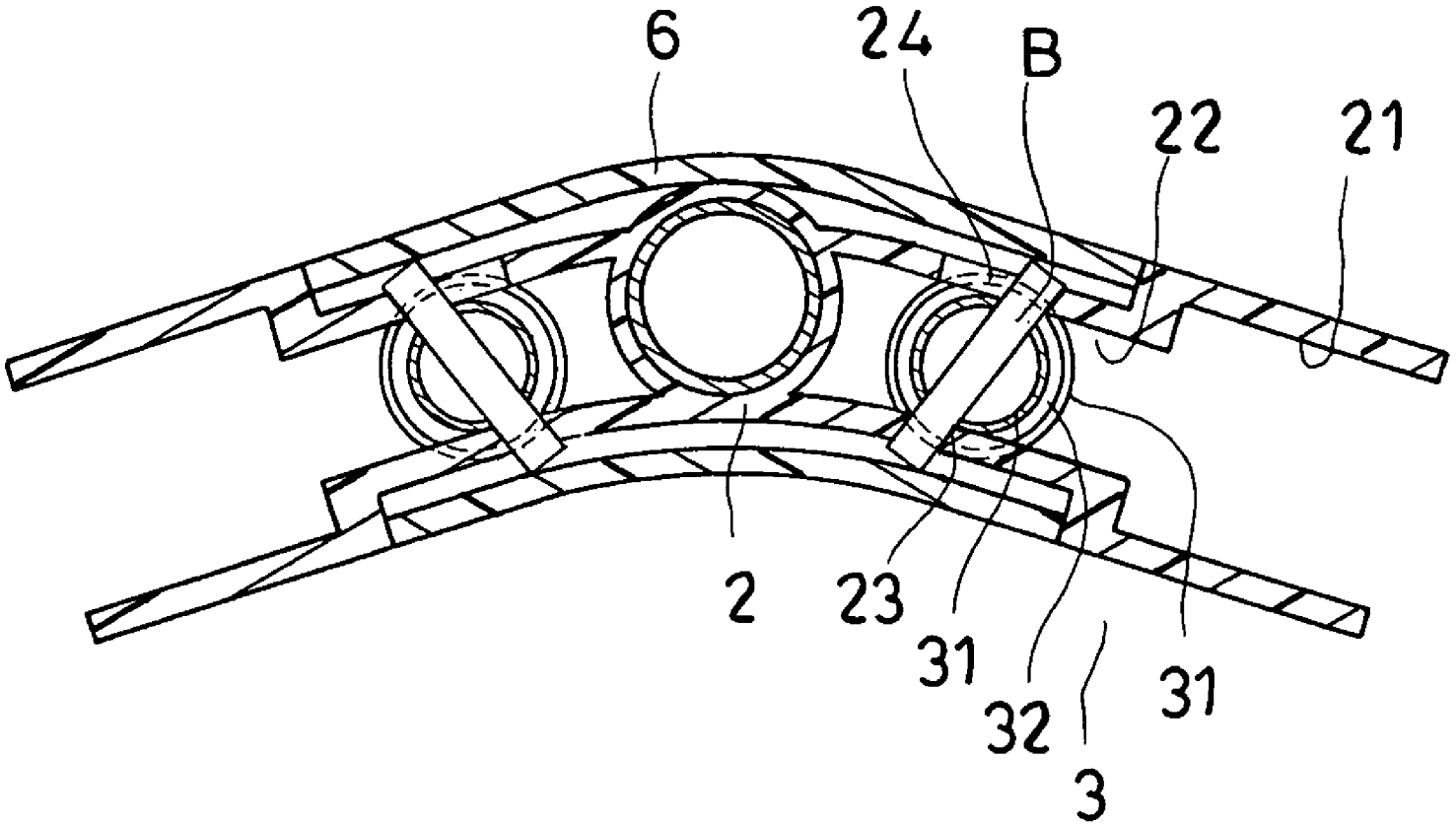
FIG. 5 is a partial sectional view of the present invention, taken when the baby mesh bed is in a folded position.
Figure 6:
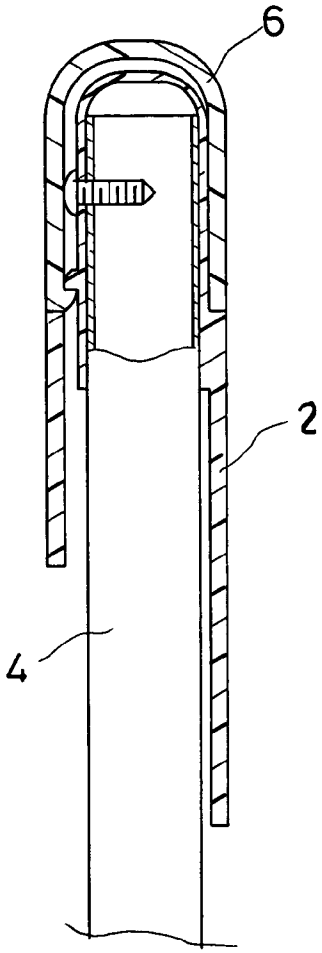
FIG. 6 is a partial vertical sectional view of the present invention.
Figure 7:
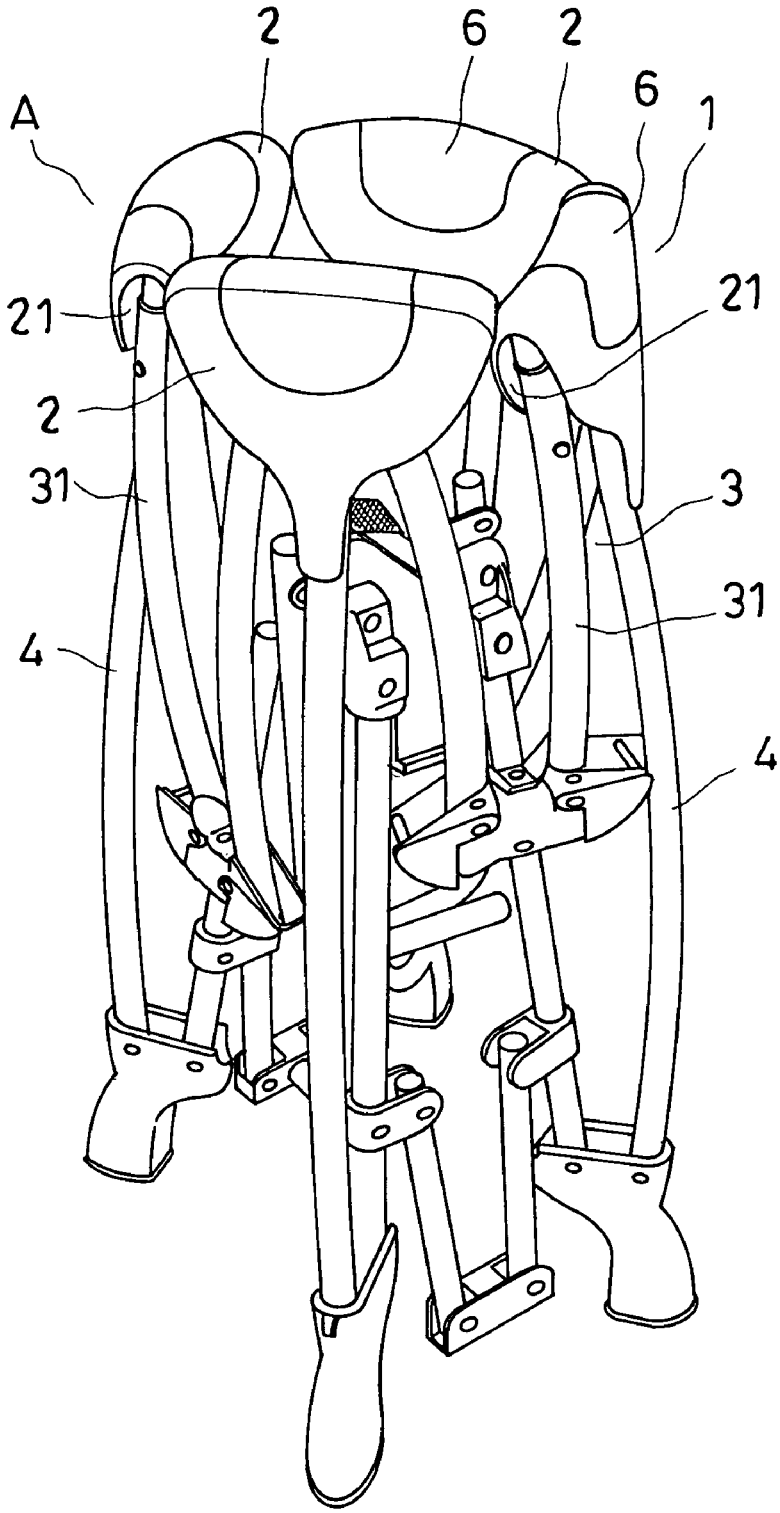
FIG. 7 is a perspective view of the present invention, folded.
Figure 8:
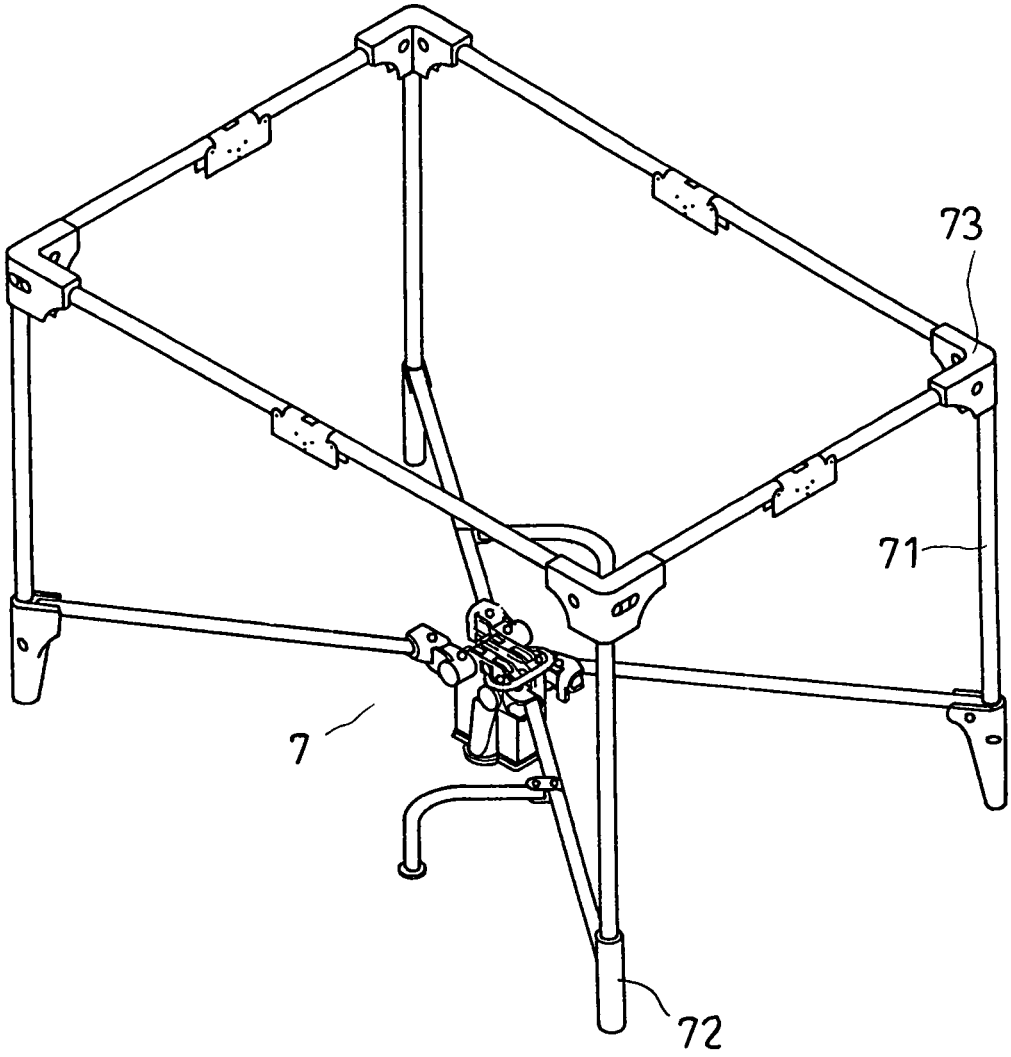
FIG. 8 (PRIOR ART)
FIG. 8 is a perspective view of the prior art.

Each of the stepped curved rods 3 are received in a respective pair of adjacent large and small internal hollowness 21 and 22 at one end thereof, and pivoted to the corresponding curved part 2 by means of a pin (B), which is passed through the hole 23, the second curved rod part 33, and the slot 24; the internal hollowness 21 and 22 of the curved parts 2 have such a size that the stepped curved rods 3 are free to pivot on the curved parts 2 in stretching/folding the baby mesh bed, as shown in FIGS. 3 to 5. Thus, when the baby mesh bed is in the stretched position, each of the second curved rod parts 33 of the stepped curved rods 3 will be received in the corresponding small internal hollowness 22, and a tail end of each of the first curved rod parts 31 will be received in the large internal hollowness 21, as shown in FIG. 3.

Furthermore, each of the curved parts 2 has an ornamental cover 6 fitted thereon for making the whole frame (A) of the baby mesh bed more pleasant-looking as well as for covering joints between the curved part 2 and the corresponding stepped curved rods 3 so as to prevent the user from getting injured in folding/stretching the baby mesh bed.

Therefore, the stepped curved rods 3 can be pivoted on the pins (B) to move the baby mesh bed to the stretched position, in which position each of the second curved rod parts 33 of the stepped curved rods 3 is received in the corresponding small internal hollowness 22, and a tail end of each of the first curved rod parts 31 in the corresponding large internal hollowness 21. When the stepped curved rods 3 are pivoting on the pins (B) towards the folded position, the pins (B) will move linearly relative to the slots 24 formed on the outer sides of the curved parts 2. Because the stepped curved rods 3 have the second curved rod parts 33 with a smaller diameter at the tail ends thereof, the amount of linear displacement of the pins (B) relative to the slots 24 of the curved parts 2 will be relatively small when the stepped curved rods 3 are pivoting on the pins (B).

From the above description, it can be easily seen that the baby mesh bed frame of the present invention has the following advantages over the currently existing ones:

1. The corner curved parts and the curved rods are combined to form an oval upper enclosing member of a baby mesh bed frame in the present invention therefore the baby mesh bed doesn't have any right angle-shaped corner, and people won't feel pain or get injured even if they hit the corners of the baby mesh bed.

2. The curved parts have the large and the small internal hollowness for receiving the large and the small rod parts of the stepped curved rods respectively therefore the baby mesh bed will be relatively steady after it is stretched.

3. Each curved part has the hole on the inner side, and the slot on the outer side thereof for the pin to pass through so as to pivot the curved rod to the curved part. Therefore, in folding the baby mesh bed, the curved rods can be smoothly pivoted on the curved parts with the pins moving linearly within the slots.

4. When the stepped curved rods are being pivoted on the pins to fold the baby mesh bed, the amount of linear displacement of the pins within the slots of the curved parts will be relatively small because the stepped curved rods are pivoted to the curved parts at the smaller-diametered second curved rod parts thereof.

What is claimed is:

1. A curved frame structure of a baby mesh bed, comprising (a) an upper enclosing member, the upper enclosing member consisting of:

Four stepped curved parts each arranged on a respective one of four corners of the upper enclosing member, each of the stepped curved parts having adjacent first and second internal hollowness in each one of two ends thereof defined by an internal step contour of the stepped curved parts; the second internal hollowness having a smaller size than the first internal hollowness; the internal hollowness having substantially same curvature as the stepped curved parts; each of the stepped curved parts having a hole on each end of an inner side thereof, and a slot on each end of an outer side thereof, which outer side opposes the inner side thereof; and a plurality of stepped curved rods, the stepped curved rods being pivoted to the stepped curved parts by means of pins, which are passed through corresponding holes and slots of the stepped curved parts at two ends thereof; each of the stepped curved rods being received in corresponding adjacent first and second hollowness of the stepped curved parts when the baby mesh bed is in a stretched position;

(b) four straight rods, the straight rods being each securely joined to a middle portion of a respective one of the stepped curved parts of the upper enclosing member; and (c) a base connected to the straight rods.

2. The curved frame structure of a baby mesh bed as recited in claim 1, wherein each of the stepped curved rods consists of a first curved rod part, a sleeve pad, and a second curved rod part; the first curved rod part having a hole; the sleeve pad having a protruding portion; the sleeve pad being fitted in the first curved rod part with the protruding portion being fitted in the hole of the first curved rod part; the first curved rod part having an inner diameter larger than an outer diameter of the second curved rod part; the second curved rod part being fitted in the sleeve pad; the first and the second curved rod parts, and the sleeve pad being secured together by means of a pin passed through them.

3. The curved frame structure of a baby mesh bed as recited in claim 1, wherein each of the curved parts has an ornamental cover fitted thereon for covering joints between the curved part and the stepped curved rods.

* * * * *